US009871296B2

(12) United States Patent
Foo

(10) Patent No.: US 9,871,296 B2
(45) Date of Patent: Jan. 16, 2018

(54) MIXED STRUCTURE DUAL-BAND DUAL-BEAM THREE-COLUMN PHASED ARRAY ANTENNA

(71) Applicant: Huawei Technologies Co., Ltd., Shenzhen (CN)

(72) Inventor: Senglee Foo, Ottawa (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 743 days.

(21) Appl. No.: 13/926,990

(22) Filed: Jun. 25, 2013

(65) Prior Publication Data

US 2014/0375502 A1 Dec. 25, 2014

(51) Int. Cl.

| | |
|---|---|
| ***H01Q 19/10*** | (2006.01) |
| ***H01Q 21/30*** | (2006.01) |
| ***H01Q 3/34*** | (2006.01) |
| ***H01Q 9/04*** | (2006.01) |
| ***H01Q 15/14*** | (2006.01) |
| ***H01Q 5/40*** | (2015.01) |

(52) U.S. Cl.

CPC ..... *H01Q 9/0414* (2013.01); *H01Q 3/34* (2013.01); *H01Q 5/40* (2015.01); *H01Q 15/14* (2013.01); *H01Q 19/10* (2013.01); *H01Q 21/30* (2013.01)

(58) Field of Classification Search

CPC ..... H01Q 15/14

USPC ..... 342/371

See application file for complete search history.

(56) References Cited

U.S. PATENT DOCUMENTS

| | | | | |
|---|---|---|---|---|
| 5,734,349 | A * | 3/1998 | Lenormand | H01Q 25/007 342/371 |
| 6,054,953 | A * | 4/2000 | Lindmark | H01Q 1/38 343/700 MS |
| 6,278,400 | B1 | 8/2001 | Cassen et al. | |
| 2008/0024382 | A1 | 1/2008 | Uddin et al. | |
| 2009/0021437 | A1 | 1/2009 | Foo | |
| 2009/0224995 | A1* | 9/2009 | Puente | H01Q 1/42 343/850 |

(Continued)

FOREIGN PATENT DOCUMENTS

| | | |
|---|---|---|
| CN | 201584489 U | 9/2010 |
| CN | 102157780 A | 8/2011 |
| CN | 202585701 U | 12/2012 |

OTHER PUBLICATIONS

International Search Report and Written Opinion received in International Application No. PCT/US2014/044943, dated Feb. 18, 2014, 10 pages.

*Primary Examiner* — Jack W Keith
*Assistant Examiner* — Helena Seraydaryan
(74) *Attorney, Agent, or Firm* — Slater Matsil, LLP

(57) ABSTRACT

Dual-band antenna elements can be used to construct a dual-beam three-column antenna array. The dual-band antenna elements include both a high-band and a low-band radiating element, which allows the dual-band antenna elements to radiate signals in two frequency bands. The dual-band antenna elements also include a resonating box to isolate the co-located radiating elements from one another, as well as to mitigate inter-band distortion. The dual-band antenna elements may be interleaved with single-band elements to achieve a dual-beam three-column antenna array. Individual elements in the dual-beam three-column antenna array may be separated by non-uniform offsets/spacings to achieve improved performance.

20 Claims, 16 Drawing Sheets

(56) References Cited

U.S. PATENT DOCUMENTS

2009/0322642 A1 12/2009 Foo

* cited by examiner

MIXED STRUCTURE DUAL-BAND DUAL-BEAM THREE-COLUMN PHASED ARRAY ANTENNA

TECHNICAL FIELD

The present invention relates generally to wireless communications, and in particular embodiments, to a mixed structure dual-band dual-beam three-column phased array antenna.

BACKGROUND

Modern day wireless cellular antennas may emit a single or multiple beam signal. Single beam antennas emit a single beam signal pointing at the bore-sight direction of the antenna, while dual-beam antennas emit two asymmetric beam signals pointing in two different directions in opposite offset angles from the mechanical boresight of the antennas. In a fixed coverage cellular network, azimuth beam patterns of a dual-beam antenna are narrower than that of a single beam antenna. For example, a dual-beam antenna may emit two beams having a half power beam width (HPBW) of about thirty-three degrees in the azimuth direction, while a single beam antenna may emit one beam having a (HPBW) of about sixty-five degrees in the azimuth direction. The two narrow beams emitted by the dual-beam antenna may typically point in offset azimuth directions, e.g., plus and minus twenty degrees to minimize the beam coupling factor between the two beams and to provide 65 deg HPBW coverage in a three-sector network.

SUMMARY OF THE INVENTION

Technical advantages are generally achieved, by embodiments of this disclosure which describe a mixed structure dual-band dual-beam three-column phased array antenna.

In accordance with an embodiment, a dual-band radiating element is provided. In this example, the dual-band radiating element comprises an antenna reflector, a low-band radiating patch mounted to the antenna reflector, and a high-band radiating patch positioned above the low-band radiating patch.

In accordance with an embodiment, a dual-band antenna is provided. In this example, the dual-band antenna comprises a plurality of single-band antenna elements configured to radiate in a first frequency band, and a plurality of dual-band antenna elements configured to radiate in both the first frequency band and a second frequency band. The single-band antenna elements and the dual-band antenna elements are arranged in a three-column array of radiating elements.

In accordance with another embodiment, a method for operating a three-by-two (3×2) azimuth beam forming network (AFBN) is provided. In this example, the method comprises receiving a left-hand beam and a right-hand beam, applying a first phase shift to a duplicate of the left-hand beam to obtain a phase-shifted left-hand beam, applying a second phase shift to a duplicate of the right-hand beam to obtain a phase-shifted right-hand beam, mixing the right-hand beam with the phase shifted left-hand beam to obtain a first mixed signal, mixing the left-hand beam with the phase shifted right-hand beam to obtain a second mixed signal, mixing a duplicate of the first mixed signal and a duplicate of the second mixed signal to obtain a third mixed signal, and transmitting the first mixed signal, the second mixed signal, and the third mixed signal over an antenna array.

In accordance with yet another embodiment, an apparatus comprising a three-by-two (3×2) azimuth beam forming network (AFBN) structure is provided. In this example, the 3×2 AFBN structure is configured to receive a left-hand beam and a right-hand beam, to apply a first phase shift to a duplicate of the left-hand beam to obtain a phase-shifted left-hand beam, and to apply a second phase shift to a duplicate of the right-hand beam to obtain a phase-shifted right-hand beam. The 3×2 AFBN structure is further configured to mix the right-hand beam with the phase shifted left-hand beam to obtain a first mixed signal, to mix the left-hand beam with the phase shifted right-hand beam to obtain a second mixed signal, and to mix a duplicate of the first mixed signal and a duplicate of the second mixed signal to obtain a third mixed signal. The 3×2 AFBN structure is further configured to transmit the first mixed signal, the second mixed signal, and the third mixed signal over an antenna array.

BRIEF DESCRIPTION OF THE DRAWINGS

For a more complete understanding of the present disclosure, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of embodiments of this disclosure are discussed in detail below. It should be appreciated, however, that the concepts disclosed herein can be embodied in a wide variety of specific contexts, and that the specific embodiments discussed herein are merely illustrative and do not serve to limit the scope of the claims. Further, it should be understood that various changes, substitutions and alterations can be made herein without departing from the spirit and scope of this disclosure as defined by the appended claims.

Base station antennas are often mounted in high traffic metropolitan areas, and consequently compact modules are typically desired as they tend to be more aesthetically pleasing (e.g., less-noticeable) as well as easier to install and service. Moreover, base station antennas often use arrays of antenna elements in order to achieve enhanced spatial selectivity (e.g., through beamforming) as well as higher spectral efficiency. Concepts for creating three-column single-beam antenna arrays are discussed in U.S. patent application Ser. No. 12/175,425, which is incorporated by reference herein as if reproduced in its entirety. However, those concepts are inappropriate for dual-beam applications. Accordingly, mechanisms and architectures for providing a three-column antenna array capable of dual-beam functionality are desired.

Aspects of this disclosure provide a dual-band antenna element that can be used to construct a dual-beam three-column antenna array. More specifically, the dual-band antenna element includes both a high-band and a low-band radiating element, which allows it to radiate signals in two frequency bands. The dual-band antenna element also includes a resonating box to isolate the co-located radiating elements from one another, and mitigate inter-band distortion. Additional aspects of this disclosure provide additional features for constructing the dual-band antenna element, as well as features for constructing the dual-beam three-column array.

Figure 1:
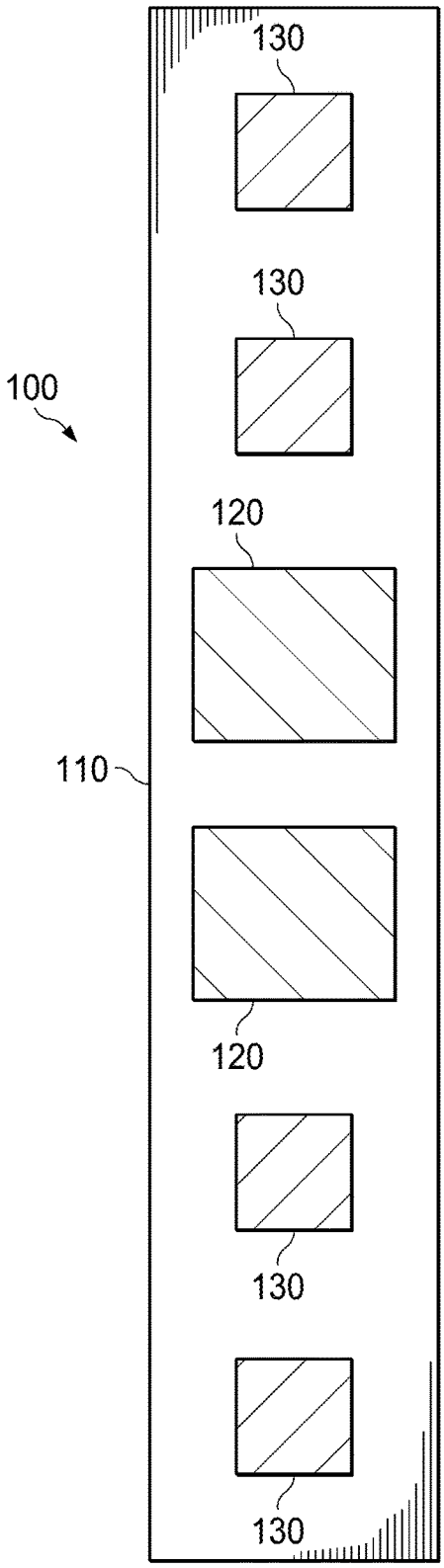
FIG. 1 (PRIOR ART)
FIG. 1 illustrates a diagram of a conventional dual-band antenna array.

FIG. 1 illustrates a conventional dual-band antenna array 100 comprising a radome 110, a plurality of low-band radiating elements 120, and a plurality of high-band radiating elements 130. As shown, the low-band radiating elements 120 and the high-band radiating elements are arranged in a single column. Notably, the low-band radiating elements 120 are typically collocated and configured to radiate in a different frequency band than the high-band radiating elements 130.

Figure 2:
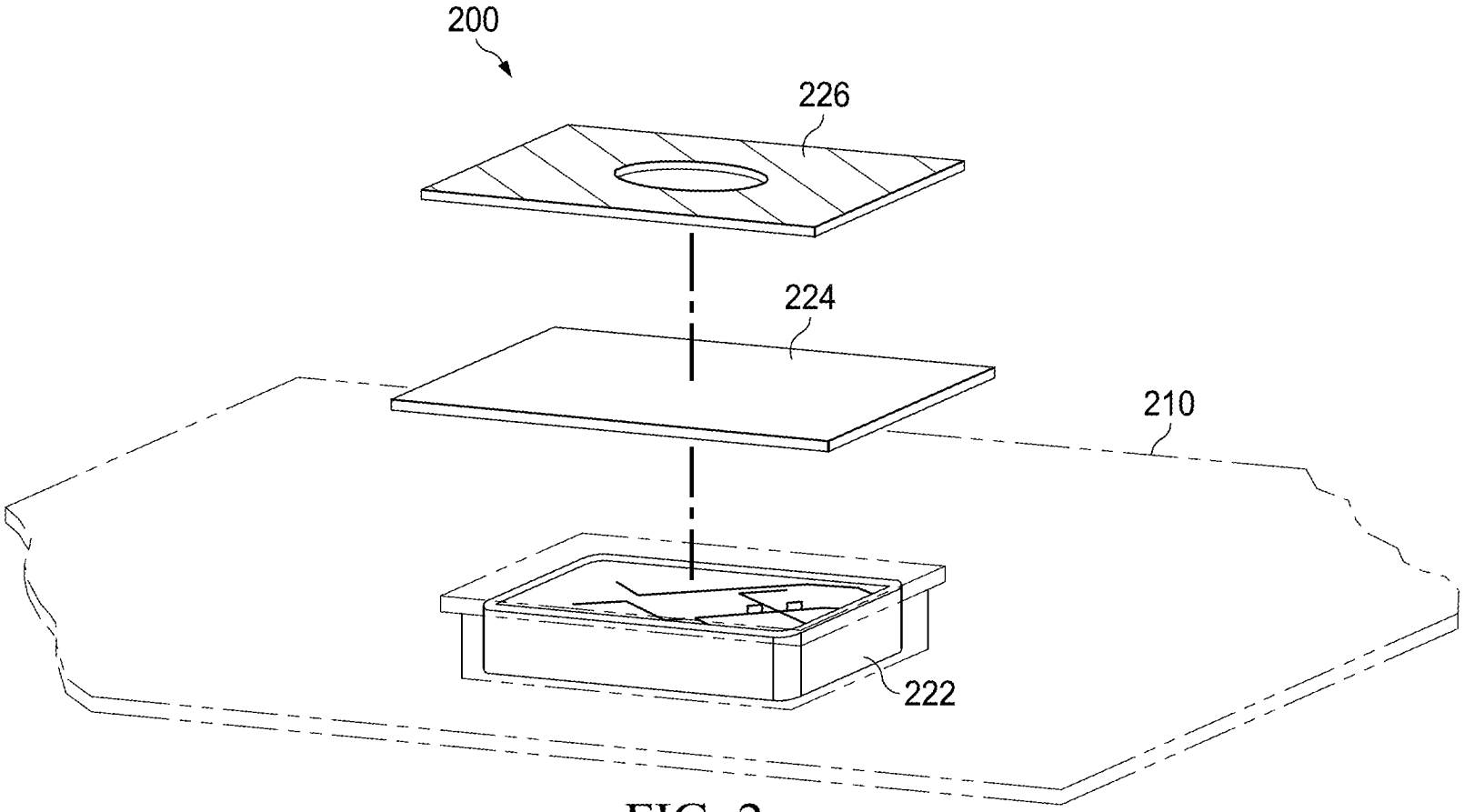
FIG. 2 (PRIOR ART)
FIG. 2 illustrates a diagram of a conventional low-band radiating element.
Figure 3:
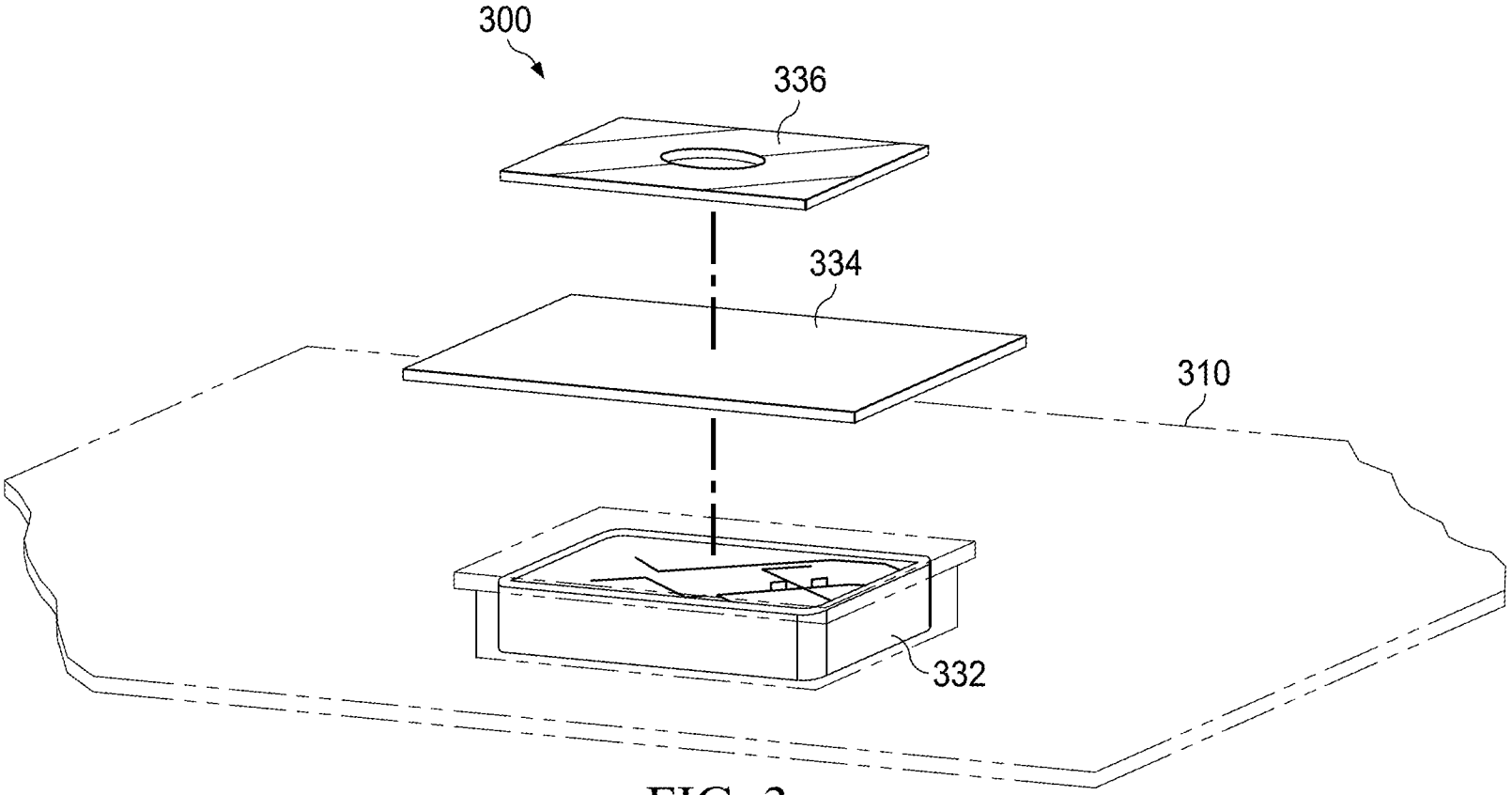
FIG. 3 (PRIOR ART)
FIG. 3 illustrates a diagram of a conventional high-band radiating element.

FIG. 2 illustrates a conventional low-band radiating element 200 mounted to an antenna reflector 210. The low band radiating element 200 comprises a back cavity 222, a printed circuit board (PCB) 224, and a low-band radiating element 226. The back cavity 222 houses active antenna components, and the PCB 224 includes interconnections for allowing the active antenna components to drive the low-band radiating element 226. FIG. 3 illustrates a conventional high-band radiating element 300 having a structure that is similar to the conventional low-band radiating element 200. The conventional high-band radiating element 300 is mounted to an antenna reflector 310, and comprises a back cavity 332, a PCB 334, and a low-band radiating element 336 configured in a similar way to like components of the conventional low-band radiating element 200. Notably, the high-band radiating element 300 is configured to operate in a different frequency band than the low-band radiating element 200

Figure 4:
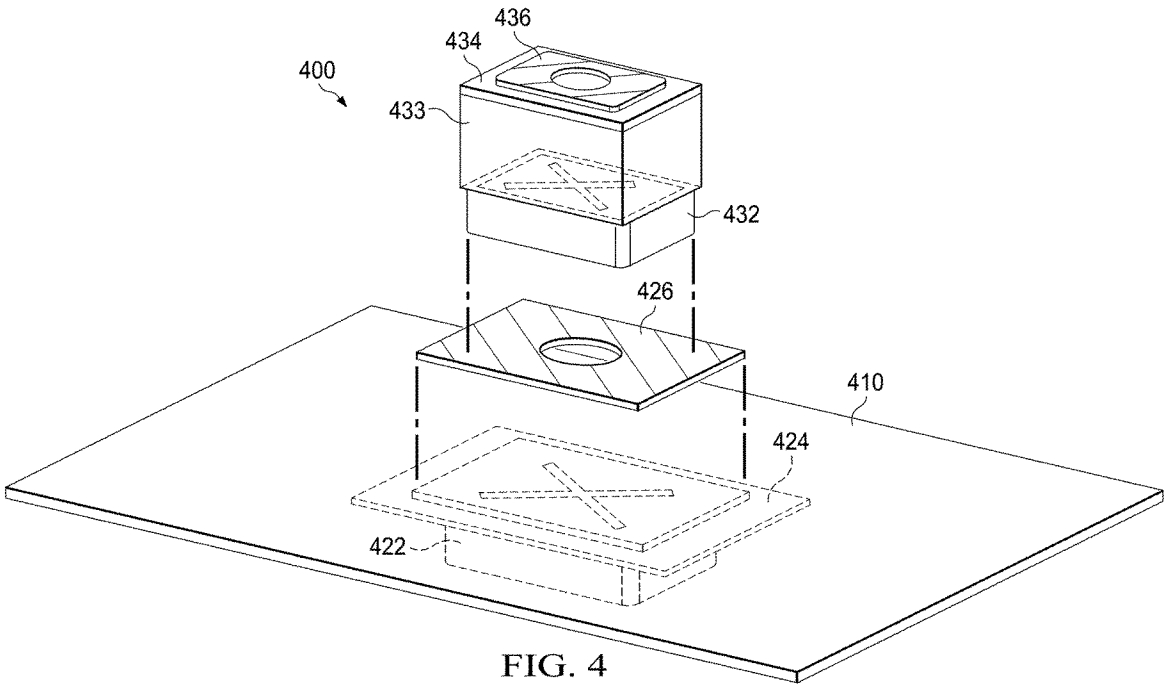
FIG. 4 illustrates a diagram of an embodiment dual-band radiating element.
Figure 5:
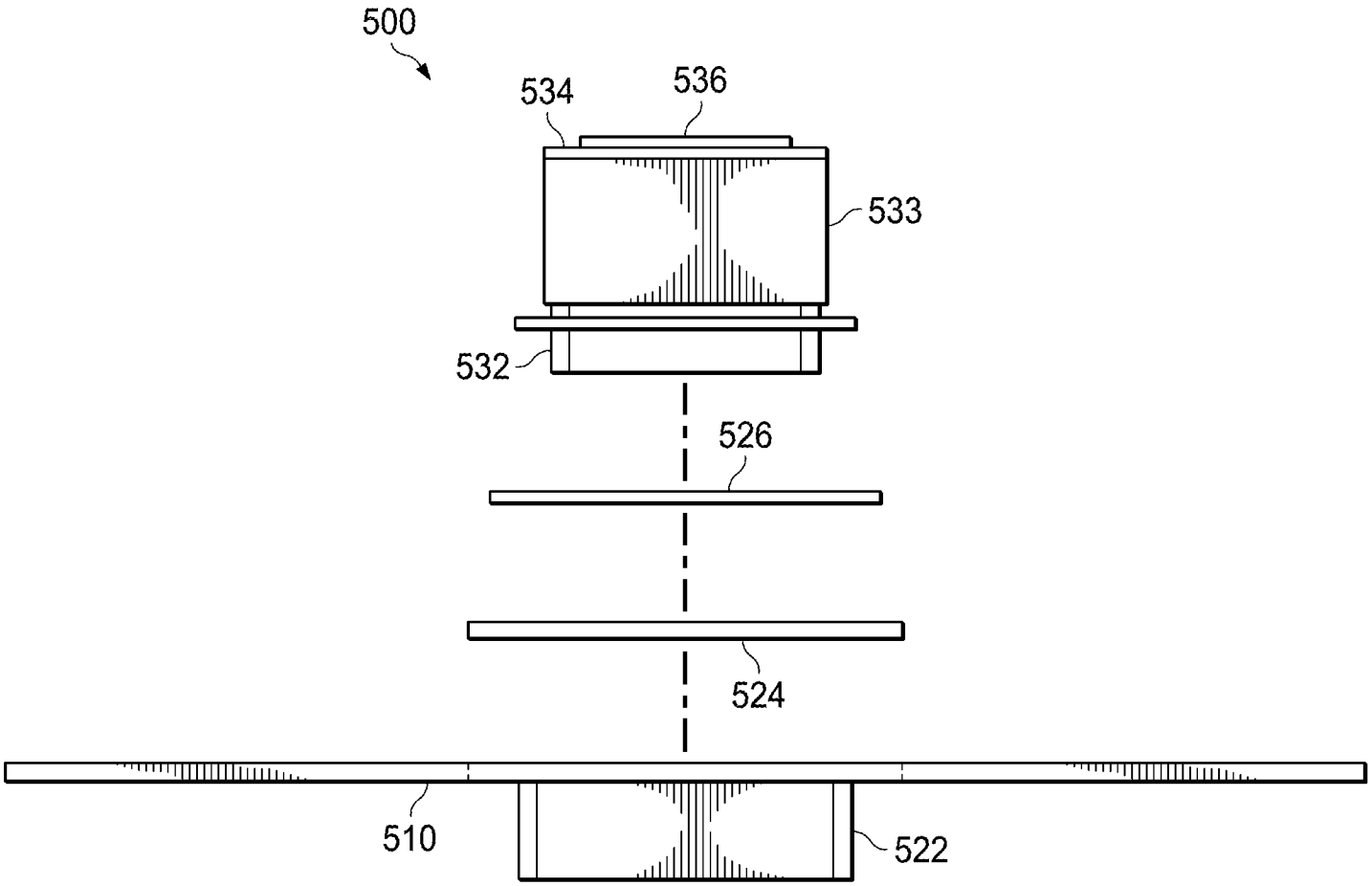
FIG. 5 illustrates a diagram of another embodiment dual-band radiating element.

Aspects of this disclosure provide a dual-band radiating element that is configured to operate in two distinct frequency bands. FIG. 4 illustrates an embodiment dual-band radiating element 400 mounted to an antenna reflector 410. The dual-band radiating element 400 comprises a low-band back cavity 422, a PCB 424, a low-band radiating element 426, a high-band back cavity 432, a radiating box 433, a PCB 434, and a high-band radiating element 436. The dual-band radiating element 400 uses the low-band radiating element 426 to emit low frequency signals, while using the high-band radiating element 436 to emit high frequency signals. FIG. 5 illustrates an embodiment dual-band radiating element 500 having a structure that is similar to the embodiment dual-band radiating element 400. The dual-band radiating element 500 is mounted to an antenna reflector 510, and includes a low-band back cavity 522, a PCB 524, a low-band radiating element 526, a high-band back cavity 532, a radiating box 533, a PCB 534, and a high-band radiating element 536. The high-band back cavity 532, the radiating box 533, the PCB 534, and the high-band radiating element 536 may be referred to as the high-band patch assembly. In some embodiments, the low band radiating element 526 may be driven by microstrip feed lines extending through low-band slots, while the high band radiating element 536 may be feed by coax lines that are fed through slots (e.g., crossways or otherwise) extending through the center of the low-band radiating element 526. Thus, the low-band radiating element 526 may be driven by different feed lines than the high-band radiating element 536.

Figure 6A:
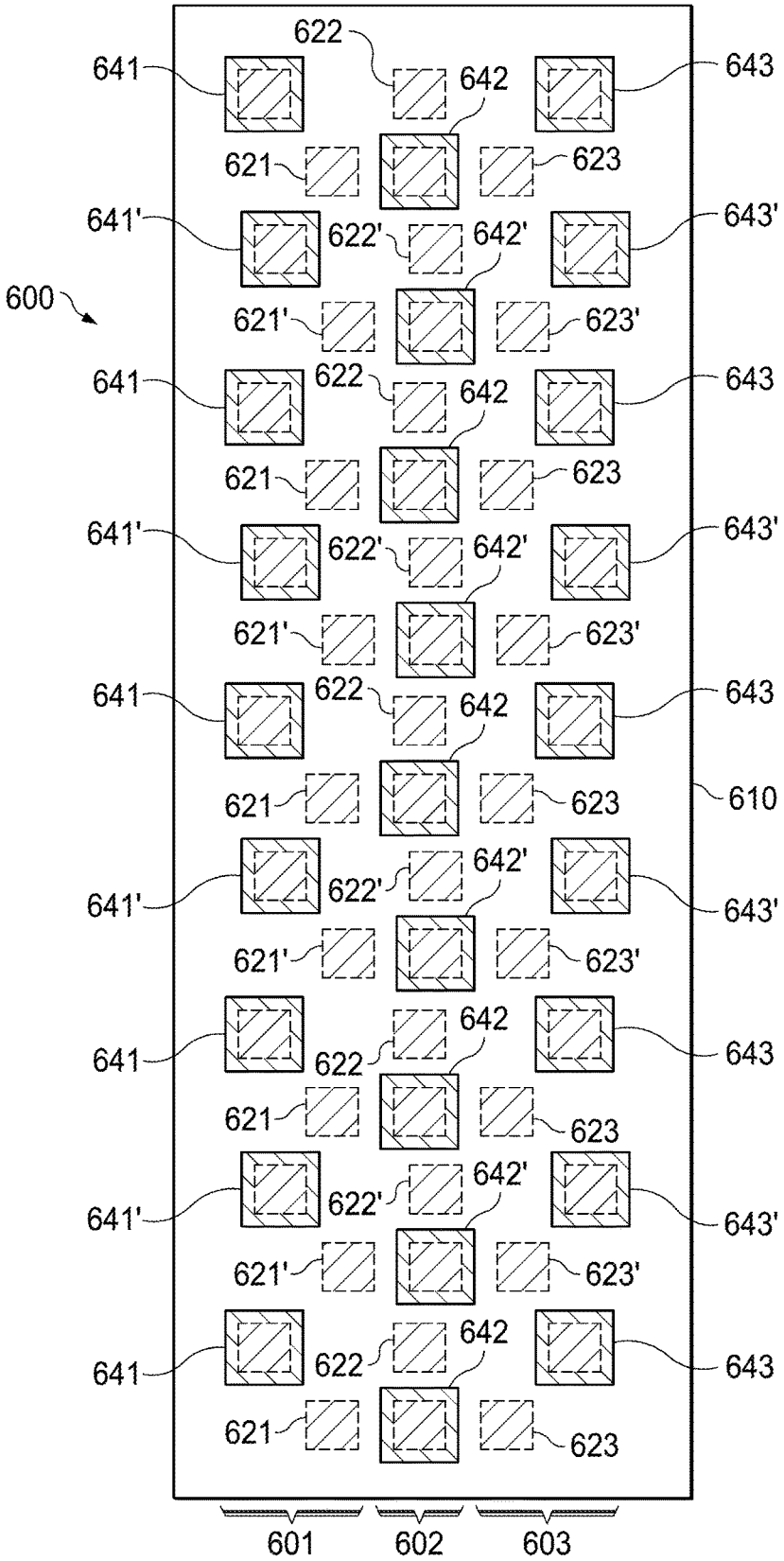
FIGS. 6A-6C illustrate diagrams of an embodiment dual-beam three-column antenna array.
Figure 6B:
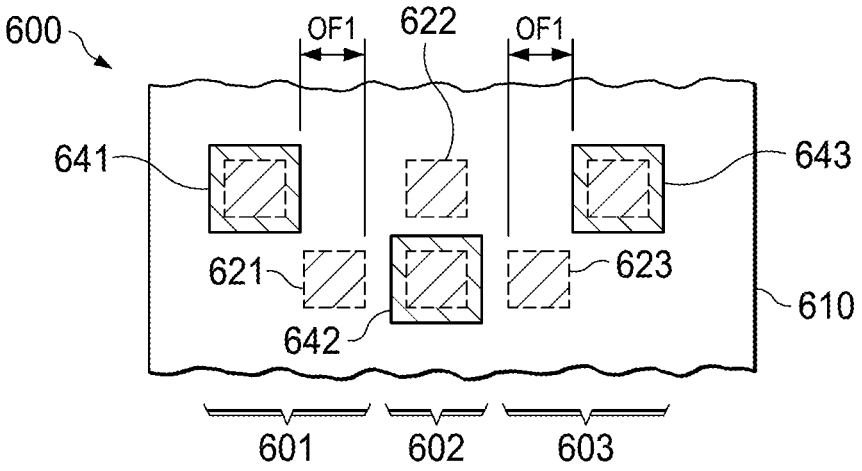
Figure 6C:
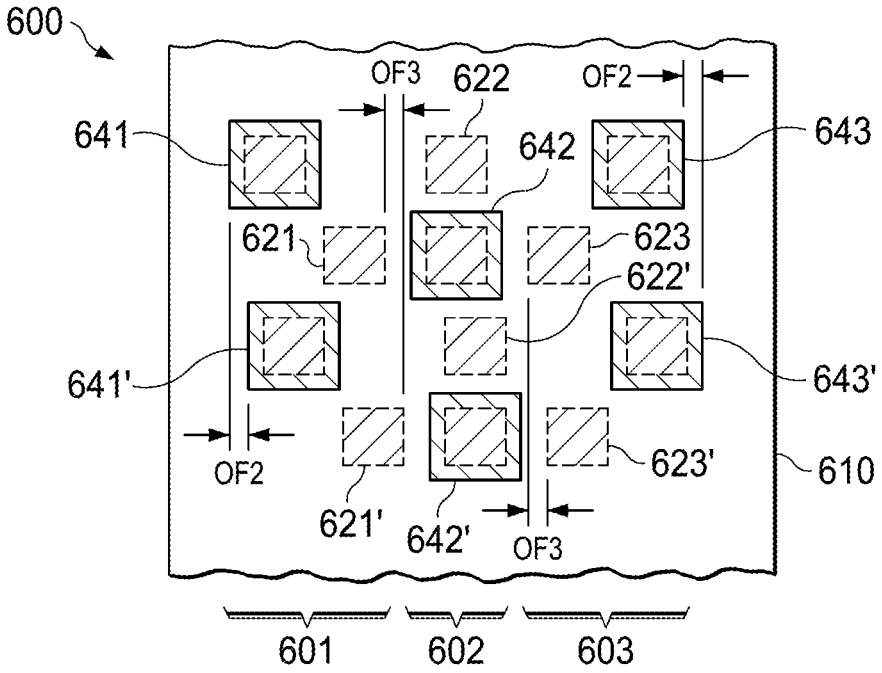

The embodiment dual-band radiating element configurations provided herein allow for a three-column dual-beam antenna array to be achieved. FIGS. 6A-6C illustrate a dual-beam three-column antenna array 600 comprising a plurality of high-band radiating elements 621-622 and a plurality of dual-band radiating elements 641-643 arranged in three columns 601, 602, 603 along an antenna reflector 610. As shown, the column 601 includes an alternating pattern of dual-band radiating elements 641 and high-band radiating elements 621, the column 602 includes an alternating pattern of dual-band radiating elements 642 and high-band radiating elements 622, and the column 603 includes an alternating pattern of dual-band radiating elements 643 and high-band radiating elements 623. As more clearly shown in FIG. 6B, the high-band radiating elements 621 and 623 in the outer-most columns 601 and 603 are inwardly offset (OF1) with respect to the dual-band radiating elements 641, 643 in the outer-most columns 601 and 603. This causes a separation between high-band radiating elements 621-623 to be less than a separation between dual-band radiating elements 641-643. Further, and as more clearly shown in FIG. 6C, odd dual-band radiating elements 641, 642, 643 are offset (OF2) with respect to even dual-band radiating elements 641', 642', 643'. Similarly, odd high-band radiating elements 621, 622, 623 are offset (OF3) with respect to even high-band radiating elements 621', 622', 623'. Notably, while the labels are excluded for purposes of clarity, the offsets OF2 and OF3 are also present between consecutive dual-band radiating elements 642, 642' and consecutive high-band radiating elements 622, 622' in the central column 602. The offsets OF2 and OF3 may be the same or equal to one another. The offsets OF2 and OF3 provide additional degree of freedom for azimuth beam shaping, particularly helpful in reducing azimuth side lobe levels.

Figure 7:
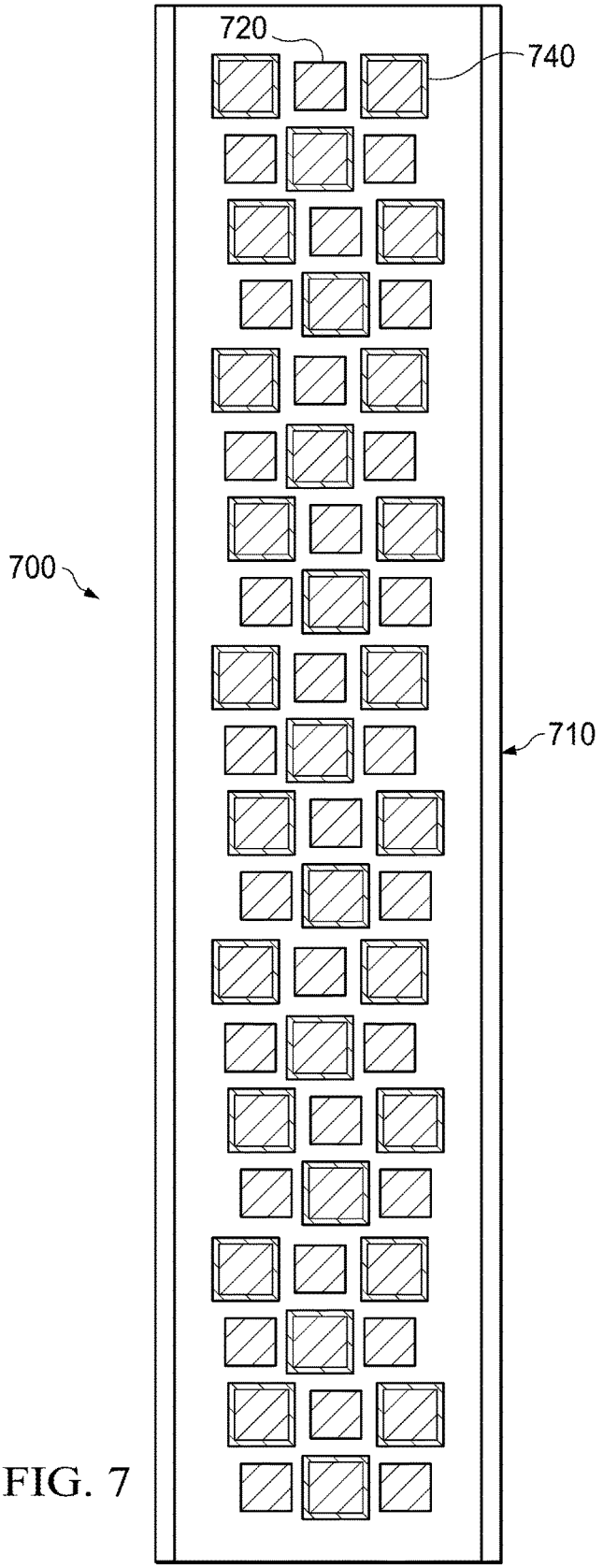
FIG. 7 illustrates a diagram of another embodiment dual-beam antenna array.

FIG. 7 illustrates an embodiment dual-beam antenna array 700 comprising an array of high-band radiating elements 720 and an array of dual-band radiating elements 740 affixed to an antenna reflector 710. Applicants have found that an element spacing of about a half-wavelength in the azimuth direction and slightly over a half-wave length in the elevation direction provide better performance than at least some other element spacings. Indeed, the aforementioned spacings may work well for spectral wavelengths of the two frequency bands with a ratio of approximately 1.2 to 2.2. The low-band radiators may be distributed in three staggered columns for improved aperture efficiency as well as to allow simpler grouping of the high-band radiators without suffering from severe pattern interference between the two bands. The high-band radiators may be distributed in a non-staggered fashion of with non-regular spacing for improved side-lobe performance. These low-band radiating elements may be further offset in the azimuth direction, alternately between rows, to further improve side-lobe performance for the both bands. While rectangular stacked patches are depicted in FIGS. 6A-6C and FIG. 7, other types of radiating elements such as dipoles may also be used. In both low-band and high-band arrays, the azimuth beams are first formed for each sub-group of array including two or more rows of the array, using a tailor made 3×2 azimuth beam forming network (ABFN). Multi-port variable phase shifters may then be used to feed these ABFNs to complete formation of the 2-dimensional array.

Aspects of this disclosure provide an apparatus for Azimuth antenna beam patterns that can be advantageously modified by varying amplitude and phase of RF signals applied to respective radiating elements in the azimuth direction. Many modern day cellular base-station antennas are designed to have a single main lobe with azimuth radiation half-power beam-width (HPBW) of 65 degrees or 90 degrees. Aspects of this disclosure introduce a three-column dual-band dual-beam antenna for high-capacity cellular operations. The proposed dual-band dual-beam antenna array produces two highly orthogonal spatial beams in two or more frequency bands using a common antenna aperture. Therefore, as an example, a total of four orthogonal azimuth beams, each with thirty-three degrees half-power beam width (HPBW), can be produced in a single dual-band dual-beam per signal polarization, as compared to only two beams by a standard sixty-five degrees dual-band array.

Aspects of this disclosure provide a methodology for fabrication of a commercially viable dual-band dual-beam array using interleaving three-column antenna array structures. Some embodiments make use of mixed configurations of three-column linear arrays to form the dual-beam array which results in improved aperture efficiency with less inter-band interference as compared to other array configurations. Embodiment antenna arrays produce four isolated asymmetric beams in the azimuth direction in two closely spaced frequency bands, e.g., one in the Universal Mobile Telecommunications System (UMTS) band (1710 MHz to 2170 MHz) and the other in a slightly higher frequency band of long term evolution (LTE) 2.5 GHz (2500 MHz to 2700 MHz). Two three-column arrays include a plurality of radiating elements operating in two separate frequency bands that are arranged in an interleaving fashion to allow proper radiations of a signal in two frequency bands. The radiating elements for the lower frequency three-column array may be arranged in staggered array configuration, while the radiating elements for the higher frequency band takes a rectangular three-column array structure in order to achieve the increased aperture efficiency with improved azimuth beam patterns and reduced inter-band interference between the two bands. Tailor made non-Butler, non-uniform 3×2 azimuth beam forming network (ABFN) are provided for satisfying the relatively complex excitations for these multi-column arrays. The ABFN circuitry may be formed such that all the orthogonal beams can operate simultaneously with low beam coupling factor, which may be beneficial for reducing network interference. In addition to the delivery of accurate amplitudes and phases to radiators, the positioning of the radiating elements may also be helpful for improving the overall beam patterns. To achieve compact size, in dual-band array structures, radiating elements of both bands sometimes occupy the same space. In this case, the high-band patch must be stacked on top of a low-band element to form a new dual-band element which allows simultaneous radiation of signals in both bands.

An embodiment of this disclosure provides an antenna array comprising a plurality of radiating elements arranged to form a plurality of columns, each column comprising at least one radiating element, each radiating element operating in at least one of a plurality of non-overlapping frequency bands, wherein within said at least one operating frequency band, each radiating element is configurable to produce a plurality of radiation beams, wherein at least one of the radiation beams is asymmetrical.

Aspects of this disclosure introduce the concept of a mixed-structure three-column antenna arrays architecture, containing a plurality of driven radiating elements that are spatially interleaved between two different types of radiating elements operating in two separate frequency bands. For each frequency band of operation, two slightly overlapping asymmetric beams with extremely low beam coupling factor are produced in the azimuth plane to provide optimum wireless cellular performance. To achieve proper dual-band operations, a new dual-band patch is also introduced here to allow simultaneous operation of the two independent arrays.

Figure 8:
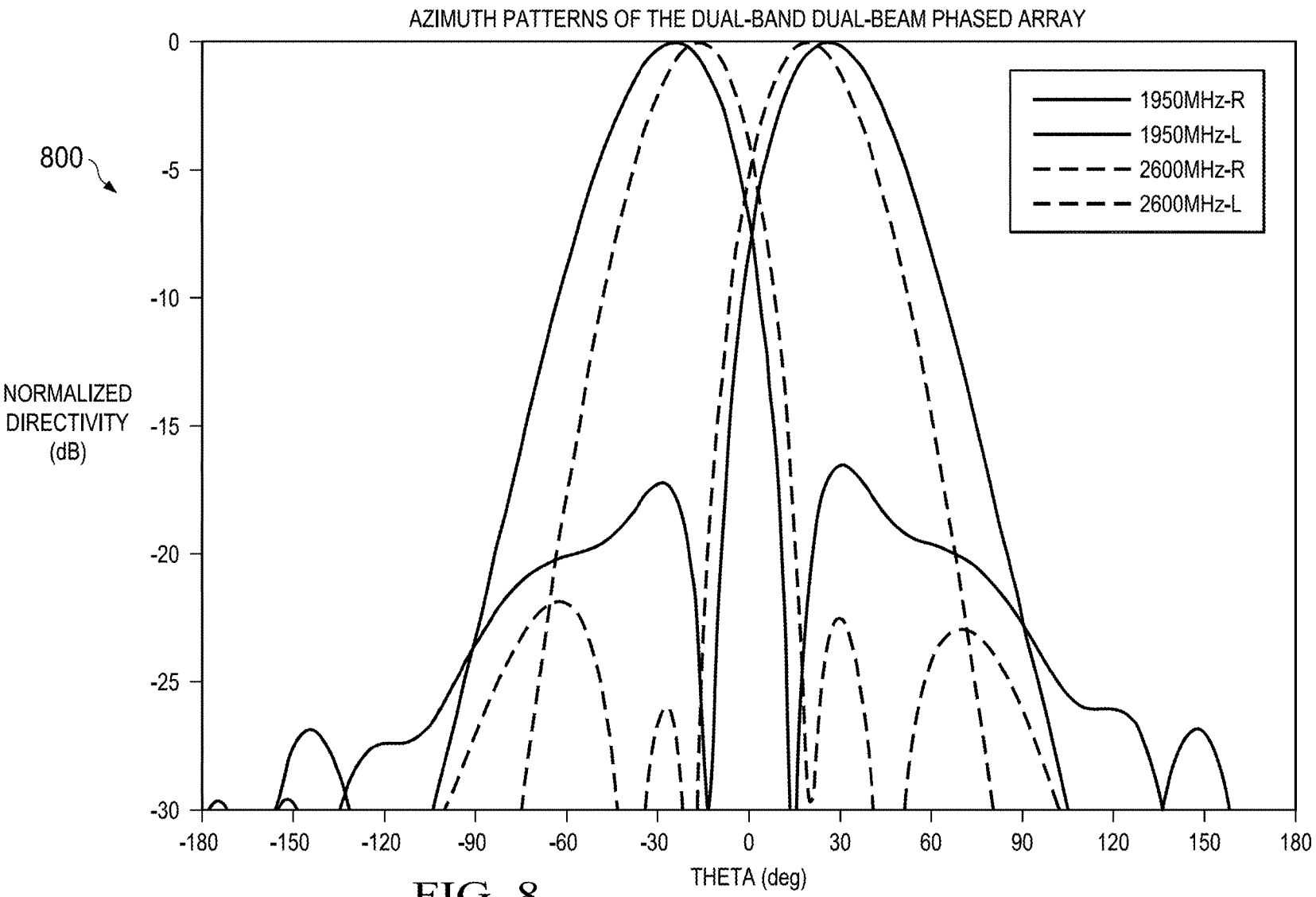
FIG. 8 illustrates a graph of azimuth radiation patterns produced by an embodiment three-column dual-beam antenna array.

FIG. 8 shows a graph of azimuth radiation patterns of an embodiment mixed-structure three-column dual-band dual-beam antenna array. As shown, for each linearly polarized signal, there are four independent asymmetric beams: high-band left (L) and right (R) beams, and low-band left (L) and right (R) beams. To encompass sixty-five degrees of cell coverage, each of the dual-beam arrays provide azimuth beam patterns with an azimuth HPBW of approximately thirty-three degrees. This way, the combined HPBW of the two beams can provide approximately the same coverage of as a standard sixty-five degree beam. Beam shapes for the radiation patterns may significantly affect network operation/performance, and consequently it may be desirable for each component beam (left and right) to be orthogonal to one another with relatively low beam coupling factors between the two beams. The beam parameters may be selected in accordance with the following formula: $\text{Min}(\beta_{RL})=\min(k^*\int E_R(\theta,\Phi)\cdot E_L(\theta,\Phi)\,d\Omega)$, where k is normalization constant, $E_R(\theta,\Phi)$ represents the radiation pattern of the right beam, and $E_L(\theta,\Phi)$ represents the radiation pattern of the left beam.

Aspects of this disclosure achieve patterns having a high roll-off rate at points in which the two component beams intersect, low azimuth sidelobes, beam cross-over from −5 dB to −9 dB between the patterns, front to back ratio of typically over 30 dB in the back of the antenna. Through the virtue of orthogonality of the BFN and spectrum isolation between the two bands, the four asymmetric beams produced by the dual-band BSA are inherently isolated. Therefore, aspects of this disclosure significantly improve network performances without having the penalty of increasing the overall size of a base-station antenna.

Aspects of this disclosure provide dual-band radiating elements. Embodiment radiating elements may use broadband stacked patch radiators, which provide relatively good broadband characteristics and produce highly polarized fields with relatively simple feed system. Aspects of this disclosure introduce a new type of dual-band patch element which allows for the radiation of signals in both bands with minimum interference between bands.

Figure 9:
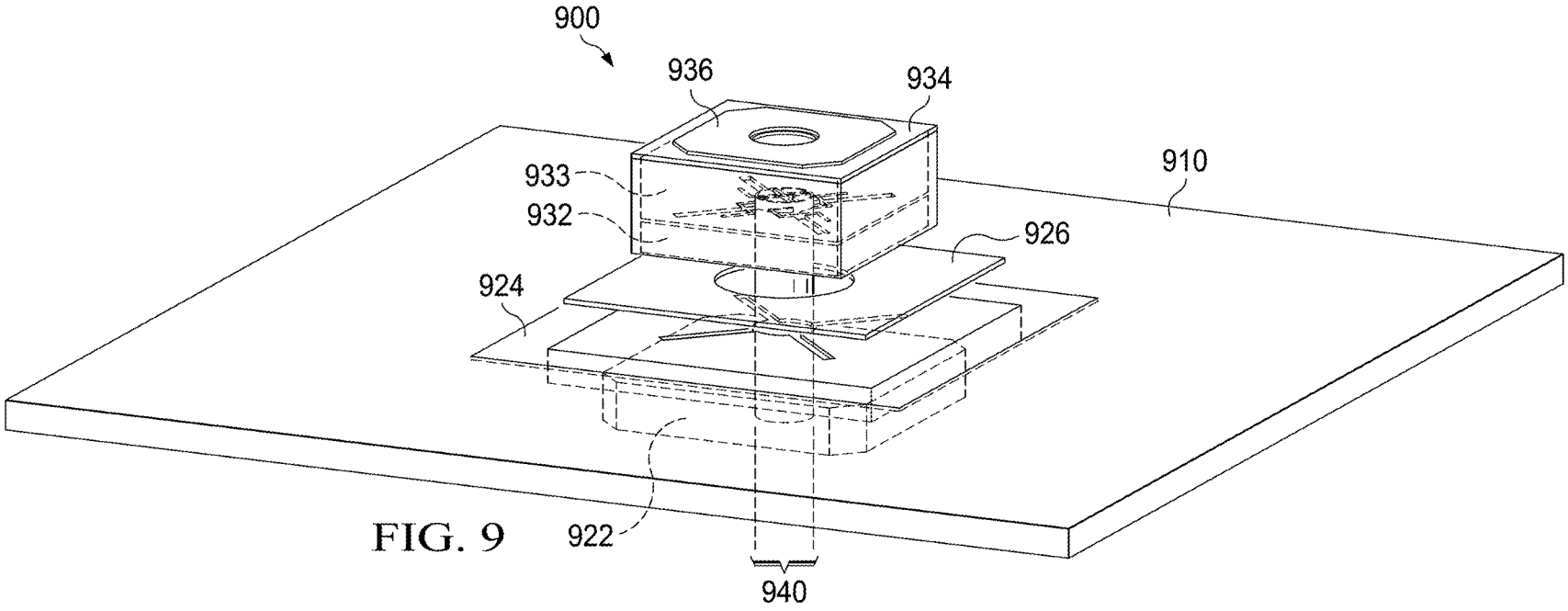
FIG. 9 illustrates a diagram of an embodiment central feed arrangement for a dual-band radiating element.
Figure 10:
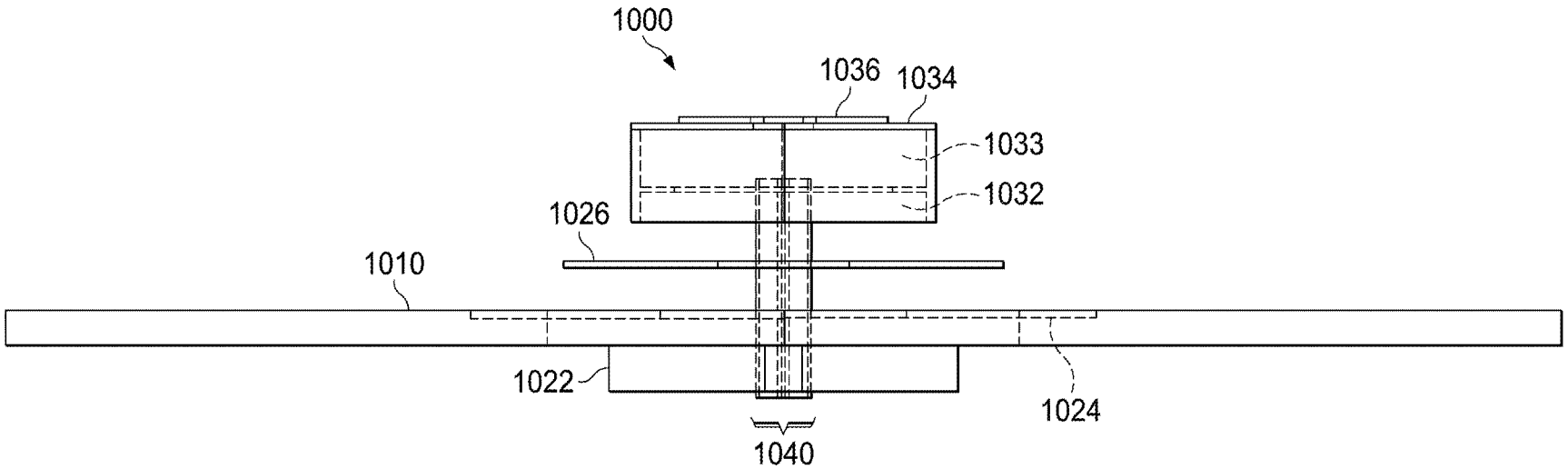
FIG. 10 illustrates a diagram of another embodiment central feed arrangement for a dual-band radiating element.

Embodiments of this disclosure provide a dual-band microstrip feed assembly to allow proper feeding of dual-polarized high-band RF signals from the bottom of the dual-band element. FIG. 9 illustrates a central feed arrangement 940 of a dual-band radiating element 900. As shown, the dual-band radiating element 900 is mounted to an antenna reflector 910, and includes a low-band back cavity 922, a PCB 924, a low-band radiating element 926, a high-band back cavity 932, a radiating box 933, a PCB 934, and a high-band radiating element 936. The central feed arrangement 940 extends through a hole and/or slots cut in the PCB 924 and the low-band radiating element 926, and feeds a high-band resonator housed in the high-band back cavity 932. FIG. 10 illustrates a central feed arrangement 1040 of a dual-band radiator 1000. As shown, the dual-band radiating element 1000 is mounted to an antenna reflector 1010, and includes a low-band back cavity 1022, a PCB 1024, a low-band radiating element 1026, a high-HW band back cavity 1032, a radiating box 1033, a PCB 1034, and a high-band radiating element 1036. The central feed arrangement 1040 extends through a hole and/or slots cut in the PCB 1024 and the low-band radiating element 1026, and feeds active antenna components housed in the high-band back cavity 1032.

Figure 11A:
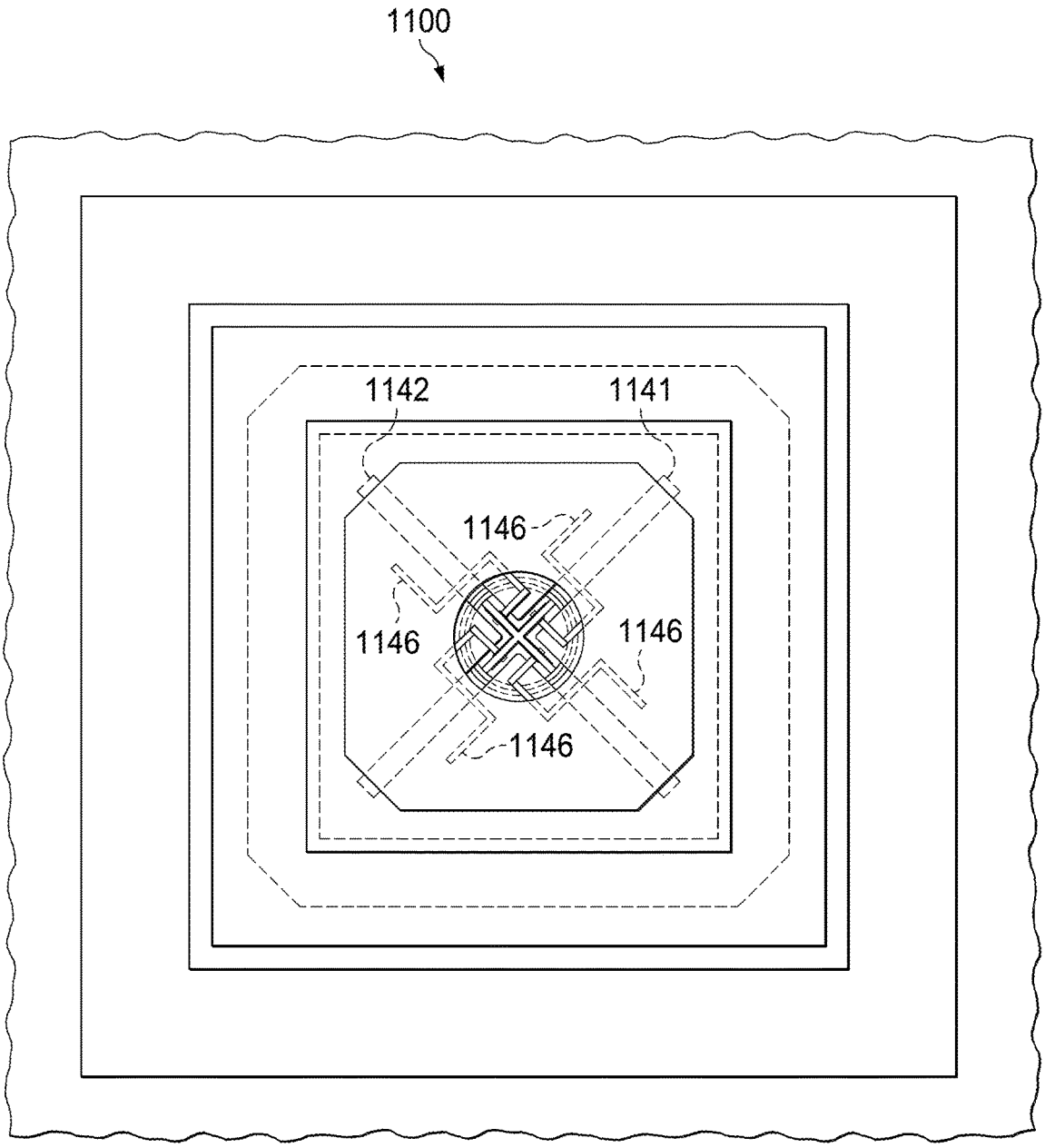
FIGS. 11A-11B illustrate diagrams of another embodiment central feed arrangement for a dual-band radiating element.
Figure 11B:
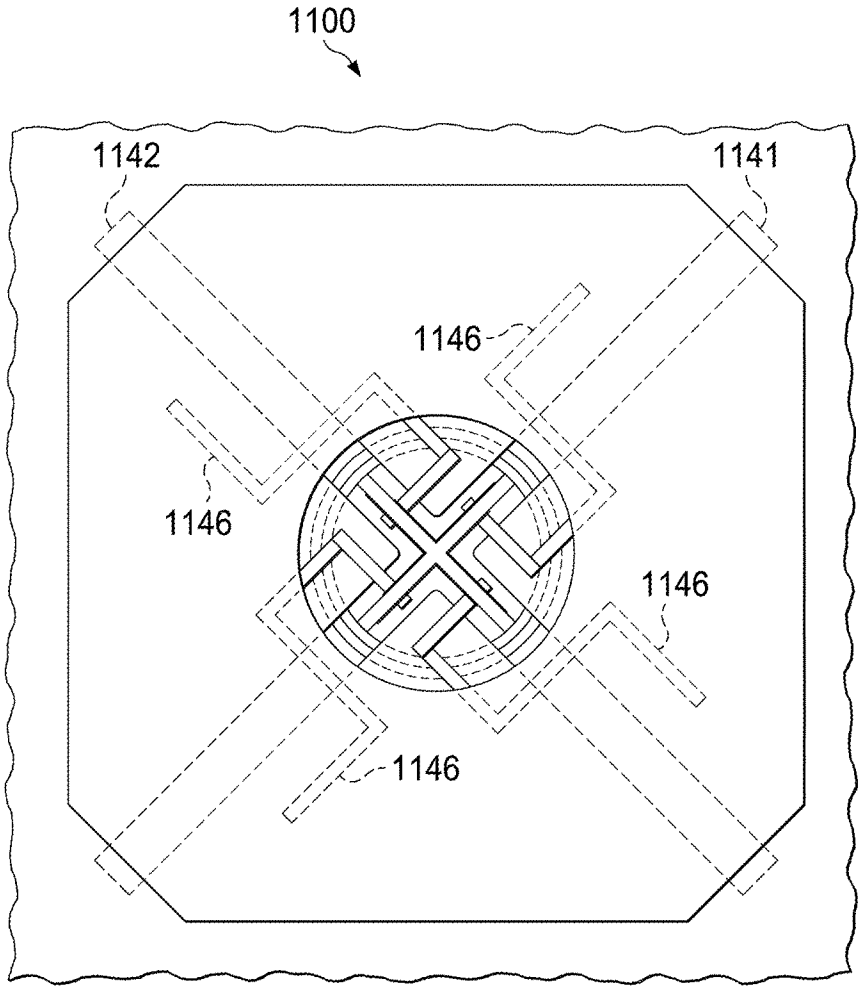

FIGS. 11A-11B illustrate top views of a central feed arrangement 1100. As shown in these figures, two radiating slots 1141, 1142 at plus and minus 45 degree angles are fed by four microstrip feed lines 1146 connected directly to the top end of the center feed assembly. The two radiating slots 1141, 1142 provide two orthogonal linearly-polarized fields with each radiating slot fed by two microstrip feed lines 1146 carrying signals of equal amplitude but opposite in phase (180 phase difference). This feed concept may utilize a microstrip power divider to divide an unbalanced RF input into two unbalanced RF outputs with 180 degree phase offset.

Figure 12:
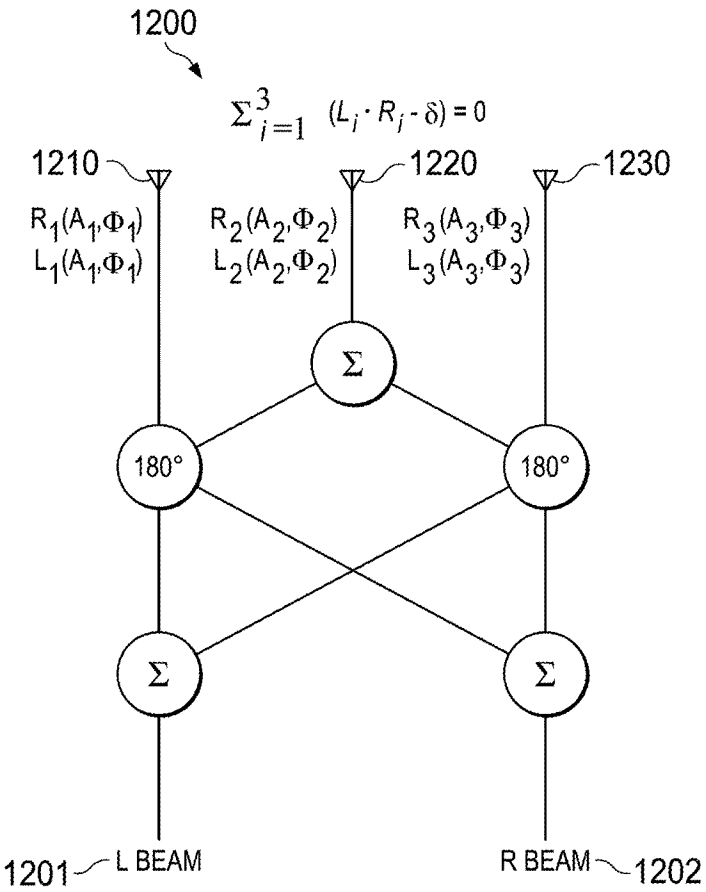
FIG. 12 illustrates a schematic diagram of an embodiment non-uniform azimuth beam forming network.
Figure 13:
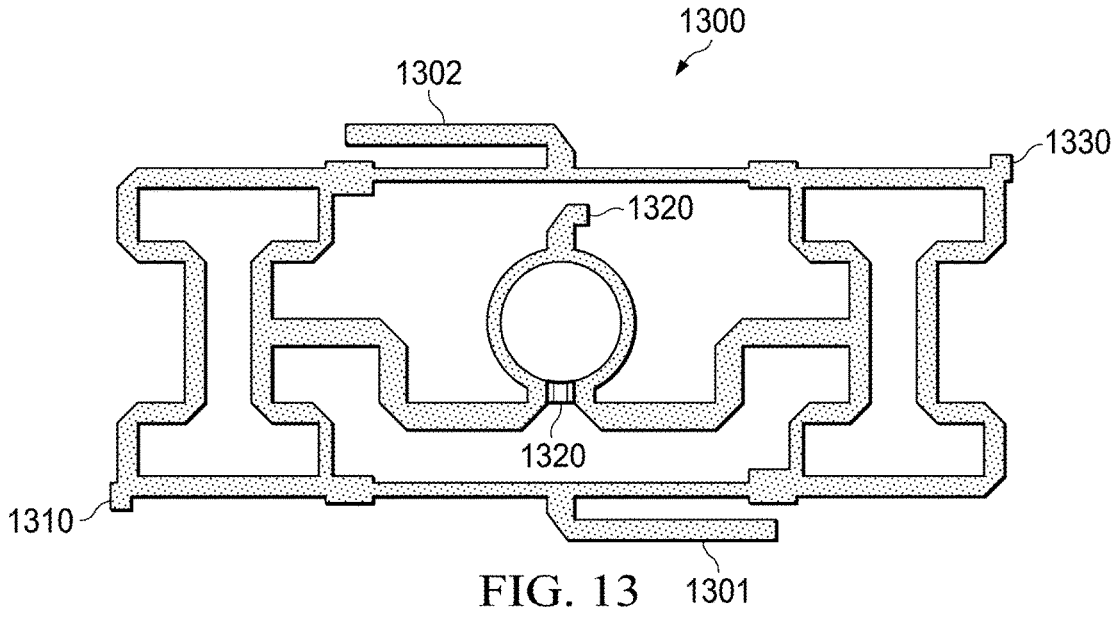
FIG. 13 illustrates a diagram of an embodiment unbalanced power divider circuit.
Figure 14:
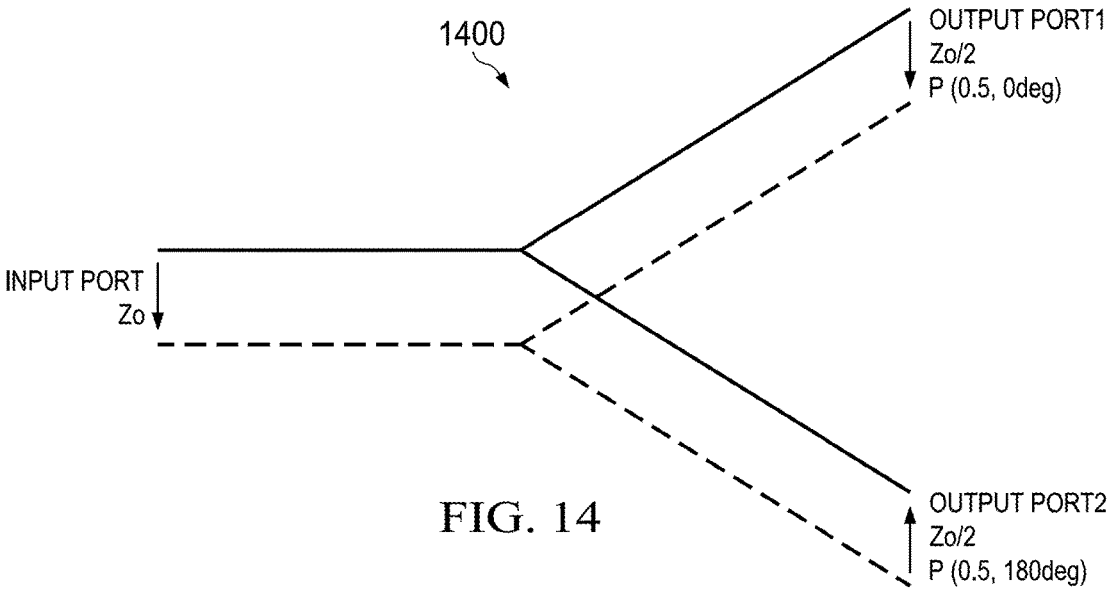
FIG. 14 illustrates a schematic diagram of an unbalanced power divider.

Aspects of this disclosure provide a 3×2 Azimuth Beam Forming Network. This may include a non-Butler, non-uniform azimuth beam forming network (ABFN). A Butler matrix may be used in forming a $2^N$ multi-beam array, where N is an integer number. In this case, the array may include a non-binary number of columns, e.g., the number of columns $\neq 2^N$. A non-Butler ABFN is developed for the three-column array to produce the desired dual-beam patterns with relatively good orthogonality between the component beams. For example, 3×2 ABFNs may be used to form a 3×10 low-band array and a 3×20 high-band array. FIG. 12 illustrates a schematic diagram of ABFN 1200. As shown, the ABFN 1200 distributes a left beam 1201 and a right beam 1202 across three component antennas 1210, 1220, and 1230. FIG. 13 illustrates a passive hybrid circuit 1330 which may be implemented as an unbalanced power divider. An ABFN that satisfies the following criteria may be capable of producing orthogonal beams (left and right): $\Sigma_1^N Li \cdot Ri = 0$, where Li represents the array excitation coefficient of column i of the left beam, and Ri represents the array excitation coefficient of column i of the right beam, and N is the total number of columns. Arrays with fewer columns may exhibit more limited degrees of freedom of this type of orthogonal BFN results in radiation patterns which are not able to simultaneously fulfill all desirable parameters such as gain, side-lobe levels and roll-off rate of beam shape in the azimuth direction. Often, these features are achieved at the expense of slight loss of beam orthogonality. Embodiments BFNs allow for improved radiation patterns without trade-off on pattern orthogonality by introducing a small loss vector δ in the excitation vector. Instead of sacrificing beam orthogonality, this loss vector allows trade-off of beam coupling factor with small sacrifice on the overall RF loss. As a result, with a little compromise on system loss, the embodiment ABFN is able to achieve the desired dual-beam radiation patterns while maintaining orthogonality between component beams. Orthogonality may be maintained between component beams when the following criteria is satisfied: $\Sigma_{i=1}^{3} L_i \cdot R_i - \delta = 0$, where, δ is a loss factor of the beam former. FIG. 14 illustrates a schematic diagram of an unbalanced power divider 1400. As shown, outport port1 and output port2 are 180 degrees out-of-phase.

Figure 15A:
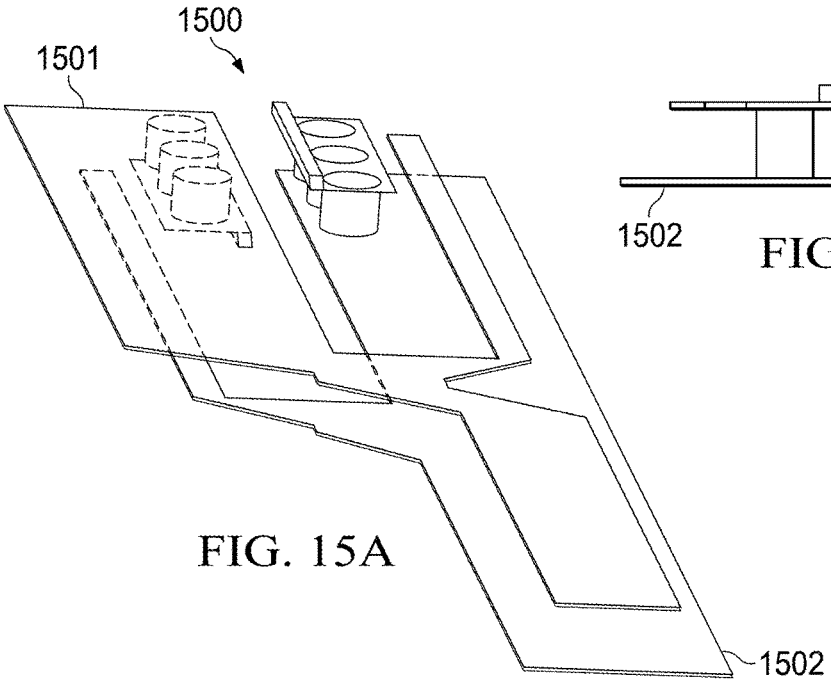
FIGS. 15A-15E illustrate diagrams of an embodiment dual-polarized 180 degree microstrip power divider.
Figure 15C:
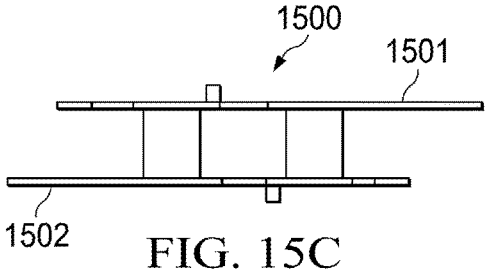
Figure 15B:
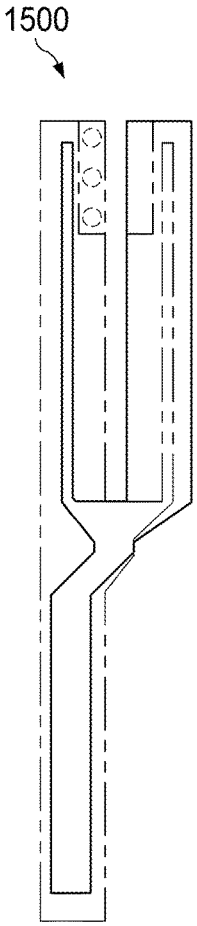
Figure 15D:
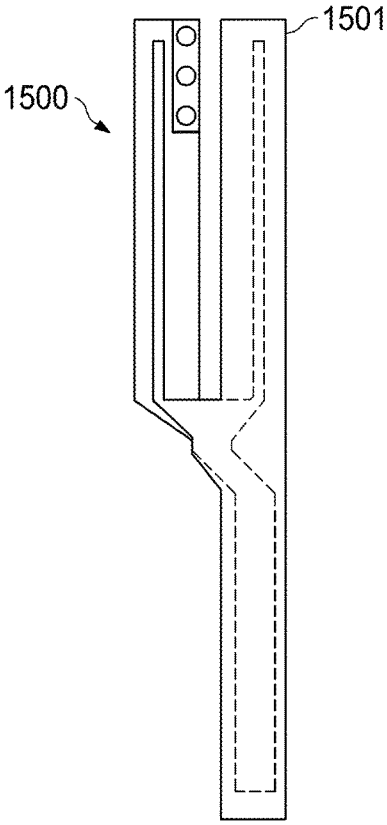
Figure 15E:
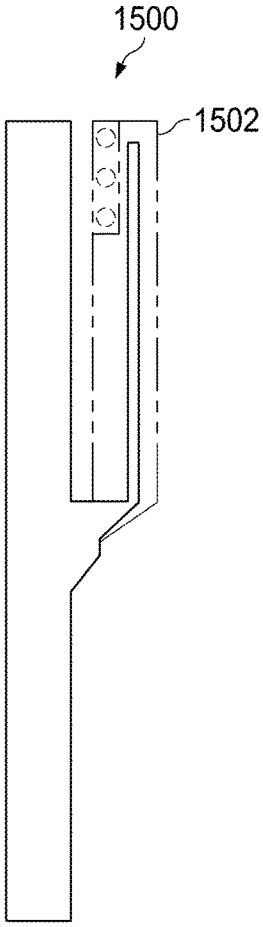
Figure 16A:
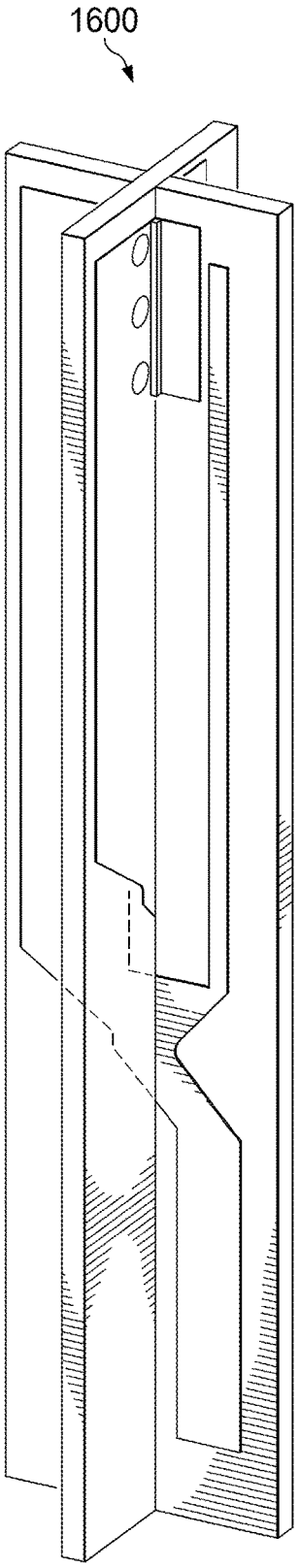
FIGS. 16A-16B illustrate diagrams of an embodiment dual-polarized 180 degree microstrip power divider assembly.
Figure 16B:
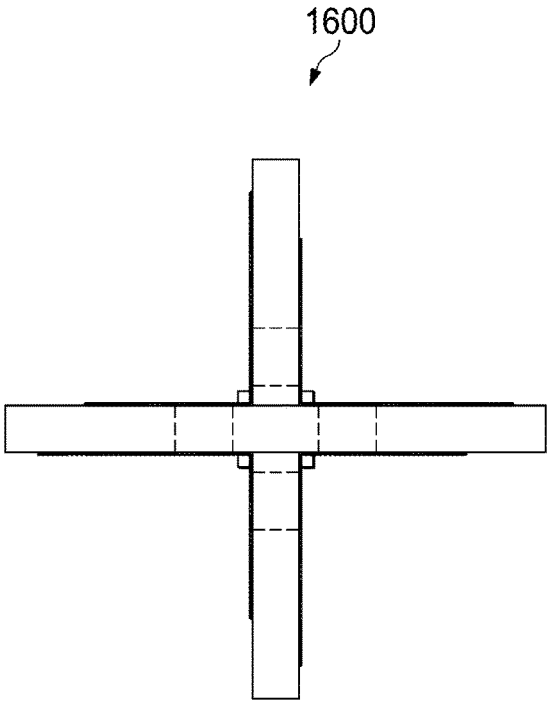

FIGS. 15A-15C illustrate an embodiment dual-polarized 180 degree microstrip power divider assembly 1500 comprising a first power divider 1501 and a second power divider 1502. The first power divider 1501 and the second power divider 1502 may be printed on separate PCBs, which may then be interlocked at a ninety degree angle with proper slots in the middle of each PCB to form the dual-polarized 180 degree feed assembly 1500. Electrical connectivity between all output ground layers is achieved through via holes on the top of PCBs. FIG. 15D illustrates the first power divider 1501 and FIG. 15E illustrates the second power divider 1502. FIG. 16A-16B illustrate an embodiment dual-polarized 180 degree microstrip power divider assembly 1600.

Figure 17:
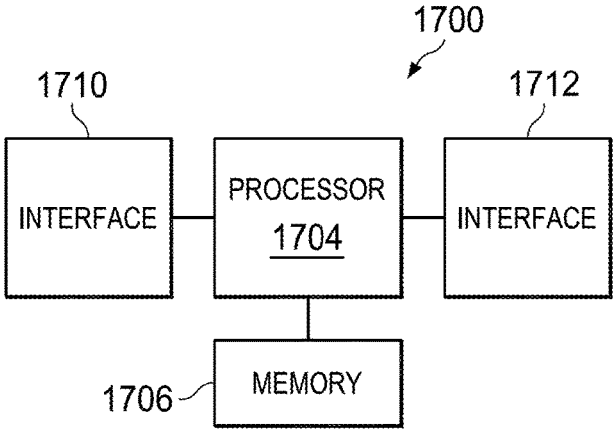
FIG. 17 illustrates a block diagram of an embodiment manufacturing device communications device.

FIG. 17 illustrates a block diagram of an embodiment manufacturing device 1700, which may be used to perform one or more aspects of this disclosure. The manufacturing device 1700 includes a processor 1704, a memory 1706, and a plurality of interfaces 1710-1712, which may (or may not) be arranged as shown in FIG. 17. The processor 1704 may be any component capable of performing computations and/or other processing related tasks, and the memory 1706 may be any component capable of storing programming and/or instructions for the processor 1704. The interface 1710-1712 may be any component or collection of components that allows the device 1700 to communicate control instructions to other devices, as may be common in a factory setting.

Although the description has been described in detail, it should be understood that various changes, substitutions and alterations can be made without departing from the spirit and scope of this disclosure as defined by the appended claims. Moreover, the scope of the disclosure is not intended to be limited to the particular embodiments described herein, as one of ordinary skill in the art will readily appreciate from this disclosure that processes, machines, manufacture, compositions of matter, means, methods, or steps, presently existing or later to be developed, may perform substantially the same function or achieve substantially the same result as the corresponding embodiments described herein. Accordingly, the appended claims are intended to include within their scope such processes, machines, manufacture, compositions of matter, means, methods, or steps.

What is claimed:

1. A dual-band radiating antenna comprising:

an antenna reflector;

a first dual-band radiating element comprising:

a low-band radiating portion comprising a low-band radiating patch mounted to the antenna reflector; and a high-band radiating portion positioned above the low-band radiating portion, the high-band radiating portion being fed through a first set of coupling slots, and the high-band radiating portion comprising:

a high-band radiating patch; and a high-band back cavity positioned below the high-band radiating patch for housing components;

a second dual-band radiating element horizontally aligned with the first dual-band radiating element;

a first high-band radiating element horizontally aligned with and located between the first and the second dual-band radiating elements;

a second high-band radiating element, a third dual-band radiating element, and a fourth dual-band radiating element horizontally aligned with each other, wherein the third and the fourth dual-band radiating elements are out of vertical alignment with each of the first and the second dual-band radiating elements; and a third high-band radiating element, a fourth high-band radiating element, and a fifth dual-band radiating element horizontally aligned with each other, wherein the third and the fourth high-band radiating elements are out of vertical alignment with each of the first and the second dual-band radiating elements, and are separated by a smaller spacing than the first and the second dual-band radiating elements, and wherein the fifth dual-band radiating element is located between the third and the fourth high-band radiating elements, and between the first and the second high-band radiating elements.

2. The dual-band radiating antenna of claim 1, wherein the low-band radiating portion further comprises a low-band back cavity affixed to the antenna reflector, the low-band back cavity housing components for driving the low-band radiating patch, wherein the antenna reflector is positioned in-between the low-band radiating patch and the low-band back cavity.

3. The dual-band radiating antenna of claim 1, wherein the first set of coupling slots produces two orthogonal linearly-polarized fields.

4. The dual-band radiating antenna of claim 3, wherein the first set of coupling slots comprises two coupling slots positioned perpendicular to each other.

5. The dual-band radiating antenna of claim 4, wherein the first set of coupling slots is fed by four microstrip feed lines.

6. The dual-band radiating antenna of claim 3, wherein the first set of coupling slots is fed utilizing a microstrip power divider.

7. The dual-band radiating antenna of claim 1, wherein the first set of coupling slots is positioned on the top surface of the high-band back cavity.

8. The dual-band radiating antenna of claim 1, further comprising a resonating box positioned in-between the high-band radiating patch and the high-band back cavity, the resonating box configured to resonate with the high-band radiating patch and to reflect signals emitted from the high-band radiating patch and the first set of coupling slots.

9. The dual-band radiating antenna of claim 8, further comprising:

a mid-plane affixed to the resonating box, wherein the mid-plane is positioned in-between the high-band back cavity and the resonating box.

10. The dual-band radiating antenna of claim 1, wherein the high-band radiating patch is configured to radiate at a higher frequency than the low-band radiating patch.

11. The dual-band radiating antenna of claim 1, further comprising:

a central feed extending through the low-band radiating portion, the central feed configured to provide feeding of radio frequency signals for the first set of coupling slots.

12. The dual-band radiating antenna of claim 11, further comprising:

a low-band feed configured to provide feeding of radio frequency signals to the low-band radiating portion, wherein the low-band feed is separate from the central feed.

13. The dual-band radiating antenna of claim 12, wherein the low-band feed provides feeding of radio frequency signals to the low-band radiating portion through a second set of coupling slots in the low-band radiating portion.

14. A method, comprising:

mounting a first dual-band radiating element to an antenna reflector, wherein the first dual-band radiating element comprises:

a low-band radiating portion comprising a low-band radiating patch mounted to the antenna reflector; and a high-band radiating portion positioned above the low-band radiating portion, the high-band radiating portion being fed through a first set of coupling slots, and the high-band radiating portion comprising:

a high-band radiating patch; and a high-band back cavity positioned below the high-band radiating patch for housing components;

mounting a second dual-band radiating element to the antenna reflector, the second dual-band radiating element being horizontally aligned with the first dual-band radiating element;

mounting a first high-band radiating element to the antenna reflector, the first high-band radiating element being horizontally aligned with and being located between the first and the second dual-band radiating elements;

mounting a second high-band radiating element, a third dual-band radiating element, and a fourth dual-band radiating element to the antenna reflector, the second high-band radiating element, the third dual-band radiating element, and the fourth dual-band radiating element being horizontally aligned with each other, wherein the third and the fourth dual-band radiating elements are out of vertical alignment with each of the first and the second dual-band radiating elements; and mounting a third high-band radiating element, a fourth high-band radiating element, and a fifth dual-band radiating element to the antenna reflector, the third high-band radiating element, the fourth high-band radiating element, and the fifth dual-band radiating element being horizontally aligned with each other, wherein the third and the fourth high-band radiating elements are out of vertical alignment with each of the first and the second dual-band radiating elements, and are separated by a smaller spacing than the first and the second dual-band radiating elements, and wherein the fifth dual-band radiating element is located between the third and the fourth high-band radiating elements, and between the first and the second high-band radiating elements.

15. The method of claim 14, wherein the low-band radiating portion further comprises a low-band back cavity affixed to the antenna reflector, the low-band back cavity housing components for driving the low-band radiating patch, wherein the antenna reflector is positioned in-between the low-band radiating patch and the low-band back cavity.

16. The method of claim 14, wherein the first set of coupling slots produces two orthogonal linearly-polarized fields.

17. The method of claim 14, wherein the first set of coupling slots is positioned on the top surface of the high-band back cavity.

18. The method of claim 14, further comprising positioning a resonating box in-between the high-band radiating patch and the high-band back cavity, the resonating box configured to resonate with the high-band radiating patch and to reflect signals emitted from the high-band radiating patch and the first set of coupling slots.

19. The method of claim 14, further comprising providing a central feed extending through the low-band radiating portion, the central feed configured to provide feeding of radio frequency signals for the first set of coupling slots.

20. The method of claim 19, further comprising providing a low-band feed configured to provide feeding of radio frequency signals to the low-band radiating portion, wherein the low-band feed is separate from the central feed.

* * * * *